US010206521B2

(12) United States Patent
Murphy

(10) Patent No.: US 10,206,521 B2
(45) **Date of Patent: *Feb. 19, 2019**

(54) ANTI-SWEEP DEVICE

(71) Applicant: Design Productions, Inc., Waldwick, NJ (US)

(72) Inventor: Thomas G. Murphy, Upper Saddle River, NJ (US)

(73) Assignee: Design Productions Inc., Waldwick, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/872,260

(22) Filed: Jan. 16, 2018

(65) Prior Publication Data

US 2018/0132630 A1 May 17, 2018

Related U.S. Application Data

(63) Continuation of application No. 15/428,851, filed on Feb. 9, 2017, now Pat. No. 9,901,188.

(60) Provisional application No. 62/293,051, filed on Feb. 9, 2016.

(51) Int. Cl.
*A47F 3/00* (2006.01)
*A47F 1/12* (2006.01)

(52) U.S. Cl.
CPC ..... *A47F 3/002* (2013.01); *A47F 1/126* (2013.01)

(58) Field of Classification Search
CPC ..... A47F 3/002; A47F 1/126
See application file for complete search history.

(56) References Cited

U.S. PATENT DOCUMENTS

| | | | |
|---|---|---|---|
| 7,641,072 | B1 | 1/2010 | Vlastakis |
| 8,190,289 | B2 | 5/2012 | Lockwood |
| 8,215,520 | B2 | 7/2012 | Miller |
| 8,353,425 | B2 | 1/2013 | Lockwood |
| 8,485,391 | B2 | 7/2013 | Vlastakis |
| 8,646,650 | B2 | 2/2014 | Lockwood |
| 2008/0245811 | A1 | 10/2008 | Colelli |
| 2010/0059469 | A1 | 3/2010 | Mason |
| 2014/0061218 | A1 | 3/2014 | Vogler |

(Continued)

FOREIGN PATENT DOCUMENTS

WO 2010141552 A2 12/2010

*Primary Examiner* — Michael Safavi
(74) *Attorney, Agent, or Firm* — Timothy X. Gibson, Esq.; Gibson & Dernier LLP

(57) ABSTRACT

Anti-sweep devices which are operable to contain a plurality of packages disposed on a base within a cover or housing, and dispense packages one at a time. A door for accessing a product such as a package is disposed at a front portion of the device. The base includes a pusher axially aligned with the long axis of the base. A sled, lift plate, product retention tab, a sled biasing element and a means for retarding a biasing force imparted by the sled biasing element are positioned below the base. The sled is slidably oriented along the longitudinal axis of the base and has a door contacting end and sled biasing element couple to the opposite end. The sled is engageable to the means for retarding a biasing force imparted by the sled biasing element. In use, opening the door to remove a product or package pushes the sled against the resistance of the sled biasing element, compressing it, and the lift plate and product retention tab are urged upward via the lift plate and through an aperture formed in the base to stop the next product or package from advancing toward the door.

19 Claims, 21 Drawing Sheets

(56) References Cited

U.S. PATENT DOCUMENTS

| | | | |
|---|---|---|---|
| 2015/0096997 | A1 | 4/2015 | Obitts |
| 2015/0321827 | A1 | 11/2015 | Lockwood |

ANTI-SWEEP DEVICE

CROSS-REFERENCE TO RELATED APPLICATIONS

This non-provisional application is a continuation of U.S. patent application Ser. No. 15/428,851 filed Feb. 9, 2017 which claims the benefit of U.S. Provisional Patent Application No. 62/293,051 filed Feb. 9, 2016, the entireties of which are incorporated by reference herein.

FIELD OF THE INVENTION

The invention relates to anti-sweep devices.

BACKGROUND

Anti-sweep devices prevent consumers from removing the entire inventory of a particular item from a store shelf. Typically anti-sweep devices are designed to dispense a single item at a time.

SUMMARY OF THE INVENTION

Anti-sweep devices are disclosed which are operable to contain a plurality of packages disposed on a base within a cover or housing, and dispense packages one at a time. A door for accessing a product such as a package is disposed at a front portion of the device. The base includes a pusher axially aligned with the long axis of the base. In practice, packages to be dispensed are placed on the base between the pusher and the door. The pusher is spring loaded and biased in the direction of the door. An assembly disposed beneath the base includes a sled, lift plate and product retention tab, a sled biasing element and a means for retarding a biasing force imparted by the sled biasing element. The sled may be disposed on a chassis. In one embodiment the sled is slidably disposed on the chassis and oriented along the longitudinal axis of the base. The sled biasing element such as a spring couples the sled to an end of the chassis opposite the door. The sled is engageable to the means for retarding a biasing force imparted by the sled biasing element. In one embodiment the means for retarding a biasing force imparted by the sled biasing element includes opposing gears between which the sled is positioned. In one embodiment the opposing gears are in turn coupled to an expansion spring that urges the gears toward the sled. In another embodiment the gears are in a fixed position relative to the sled. In a preferred embodiment the bearing surface(s) of the gears have damping grease applied to them so the motion of the gears is controlled, slow and consistent. The lift plate is coupled to the sled at a top portion thereof, below the base, and the product retention tab extends from an end of the lift plate. In use, opening the door to remove a product or package pushes the sled against the resistance of the sled biasing element, compressing it, and the lift plate and product retention tab are urged upward via the lift plate and through an aperture formed in the base to stop the next product or package from advancing toward the door. Keeping the door open causes the product retention tab to stay in the raised position, preventing advancement of the next package. Upon closing the door, the sled biasing element urges the sled forward, against the means for retarding a biasing force imparted by the sled biasing element, lowering the product retention tab slowly. Once the product retention tab has retracted through the aperture, the next product or package is advanced and can be accessed.

In accordance with one or more embodiments an anti-sweep device for dispensing products one at a time includes a door operable to have an open position and a closed position, the door restricting access to products which may be housed within the dispensing device, a base including a product bearing side and a pusher assembly operable to urge product along the product bearing side in the direction of the door, the product bearing side including a retaining tab aperture configured to receive the passage therethrough of a product retention tab operable to stop the advance of a product, a sled assembly coupled to the base including a chassis, a sled slidably coupled to a floor of the chassis and axially aligned with the base, the sled including a door-contacting end, an opposite end coupled to a sled biasing element and at least one ramp extending from the sled in a direction opposite the floor of the chassis, the sled assembly further including a means for retarding a biasing force imparted by the sled biasing element, the sled assembly further including a lift plate coupled at a first end to the chassis and positioned between a top surface of the sled and the base, the lift plate further including a ramp-contacting end opposite the first end and the product retention tab, and a housing configured to contain products to be dispensed, the housing including an open end sized and configured to accommodate the door, wherein when the door is opened, a bottom portion of the door is operable to contact and urge the sled against resistance of the sled biasing element, causing the ramp to urge the lift plate ramp-contacting end upward and the product retention tab to rise through the product retention tab aperture of the base to prevent product advancement along the product bearing side, and wherein closing the door releases pressure on the sled, wherein the sled biasing element is operable to urge the sled toward the door against a retarding force imparted by the means for retarding a biasing force, causing the lift plate and product retention tab to be lowered slowly, in most, if not all, cases, more slowly than it was raised. In normal use the product retention tab will be raised quickly, as opening the door fully is operable to raise the product retention tab to its full height.

In one or more embodiment the means of retarding a biasing force imparted by the sled biasing element includes at least one gear rotatably mounted to the chassis and positioned to engage at least one gear engaging surface of the sled. In one embodiment the means of retarding a biasing force imparted by the sled biasing element includes gears positioned in opposition to each other on either side of the sled. In another embodiment the gears are coupled to respective gear bases and the respective gear bases are slidably mounted to the chassis to move reciprocally in a direction transverse to the sled, wherein the respective gear bases are coupled to each other via a biasing element configured to bias the gear bases toward each other. In one or more embodiments at least one of the gears includes damping grease applied to a bearing of the at least one gear.

In another embodiment the product retaining tab extends from the lift plate proximal the ramp contacting end of the lift plate. The product retention tab may be pivotably coupled to the lift plate. The lift plate may be pivotably coupled at the first end to the chassis.

In still further embodiments, the pusher assembly includes a pusher slidably coupled to the product bearing surface of the base and a pusher biasing element coupled at a first end to the pusher and at a second, opposite end to the base proximal the door, wherein the pusher biasing element extends through an opening formed in the product retention tab.

In yet further embodiments, the base includes at least one pusher retention tab positioned on the product bearing side proximal an end of the base opposite the door, the at least one pusher retention tab configured to stop the pusher from extending past the pusher retention tabs. The base may include a pusher stop receptacle positioned on the product bearing side proximal an end of the base opposite the door, and a pusher stop configured to removably fit in the pusher receptacle.

In further embodiments, the door includes a planar surface including a top edge, a bottom edge and opposing walls formed at a periphery of the planar surface between the top and bottom edges and extending from the planar surface in a direction toward the pusher, and further includes at least one support surface between the opposing walls extending from the planar surface in a direction toward the pusher, the opposing walls and support surface forming a product support structure. The door may be pivotably coupled to the chassis. The bottom portion of the door may be positioned within the base. In some embodiments the bottom portion of the door includes at least one magnet positioned to magnetically attract a metal plate positioned in a region of the base proximate the bottom portion of the door.

In still further embodiments a sled biasing element adjustment device is coupled to the chassis and the sled biasing element. The sled biasing element adjustment device may include thumbwheel threadably engaged to a nut, permitting adjustment of the biasing force of the sled biasing element.

BRIEF DESCRIPTION OF THE DRAWINGS

For the purposes of illustration, there are forms shown in the drawings that are presently preferred, it being understood, however, that the invention is not limited to the precise arrangements and instrumentalities shown.

DETAILED DESCRIPTION OF THE INVENTION

Figure 1:
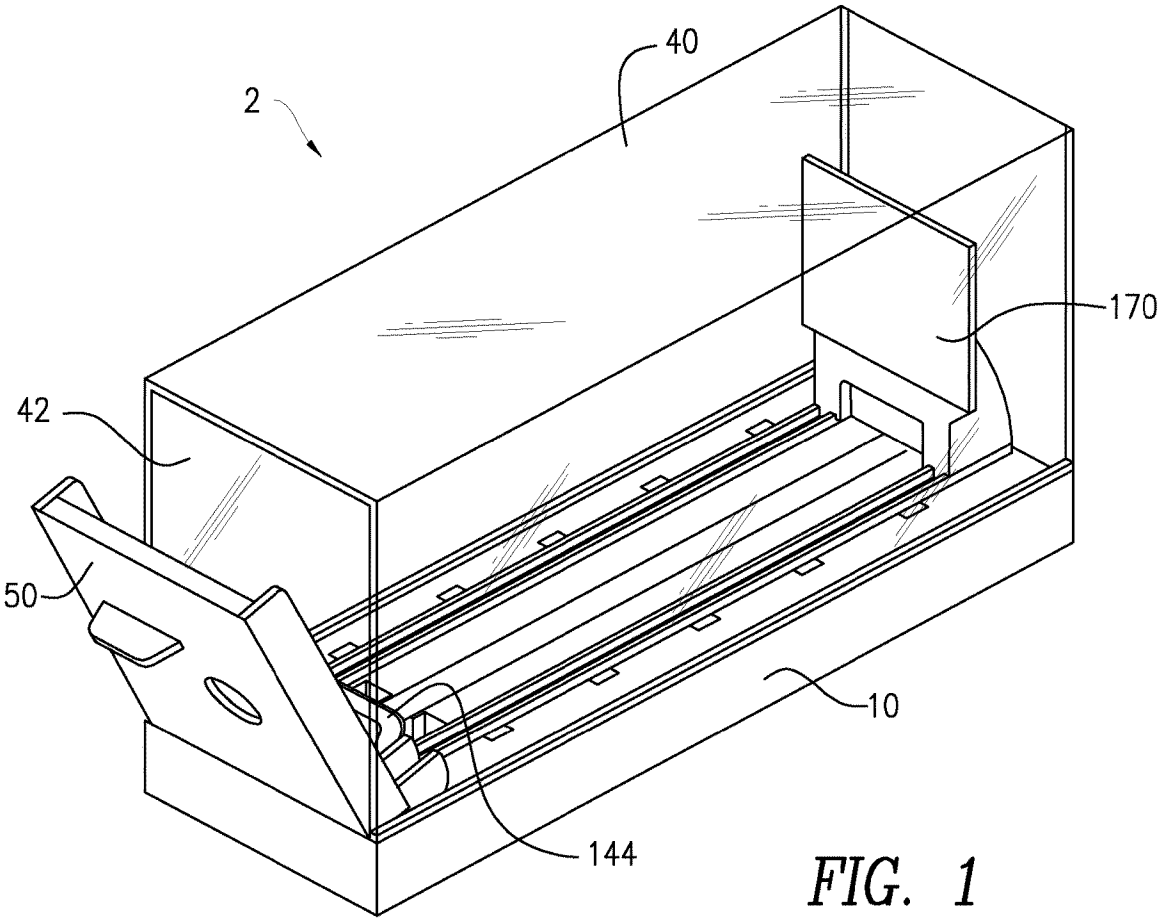
FIG. 1 is a perspective view of an anti-sweep device in accordance with one or more embodiments of the present invention.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout. As used herein the term "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Although the devices and systems of the present disclosure have been described with reference to exemplary embodiments thereof, the present disclosure is not limited thereby. Indeed, the exemplary embodiments are implementations of the disclosed systems and methods are provided for illustrative and non-limitative purposes. Changes, modifications, enhancements and/or refinements to the disclosed systems and methods may be made without departing from the spirit or scope of the present disclosure. Accordingly, such changes, modifications, enhancements and/or refinements are encompassed within the scope of the present invention.

Referring to FIG. 1 an anti-sweep device 2 operable to contain and dispense a plurality of packages or products includes a base 10, a housing 40 having an opening 42, a door 50 for accessing a product or package disposed within the housing 40 and a pusher 170 axially aligned with the long axis of the base 10. In practice, packages to be dispensed are placed on the base 10 between the pusher 170 and the door 50. The pusher 170 is spring loaded and biased in the direction of the door 50.

Figure 1A:
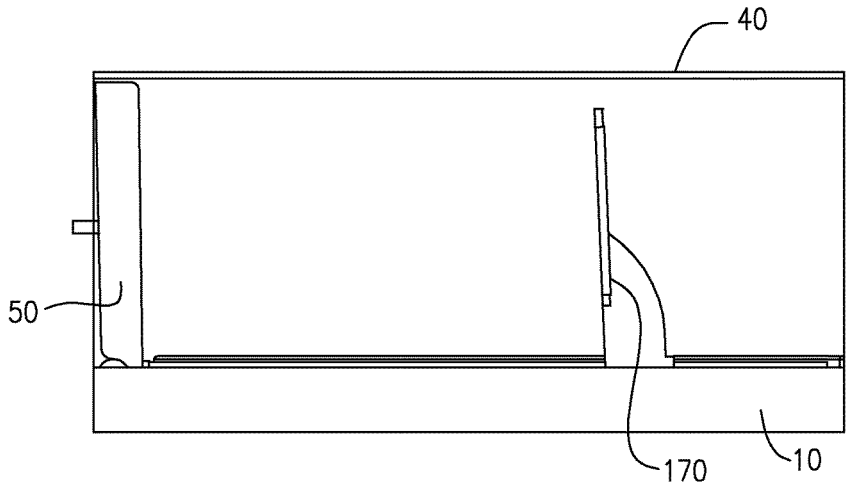
FIG. 1A is a side view of the anti-sweep device of FIG. 1 with the door closed in accordance with one or more embodiments of the present invention.
Figure 1B:
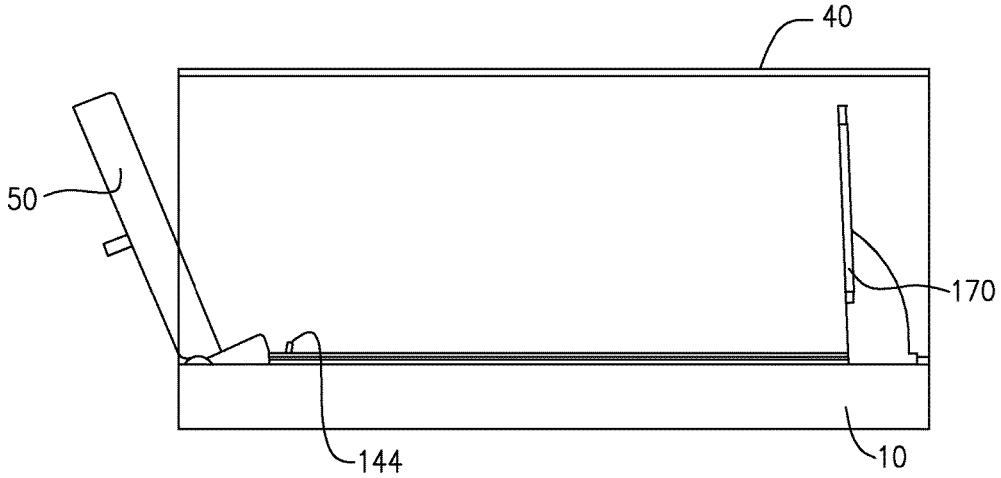
FIG. 1B is a side view of the anti-sweep device of FIG. 1 with the door opened in accordance with one or more embodiments of the present invention.

Now referring to FIGS. 1A and 1B, a product retention tab 144 is disposed beneath the base 10 and operable to extend upward from below the base 10 upon opening of the door 50.

Figure 2:
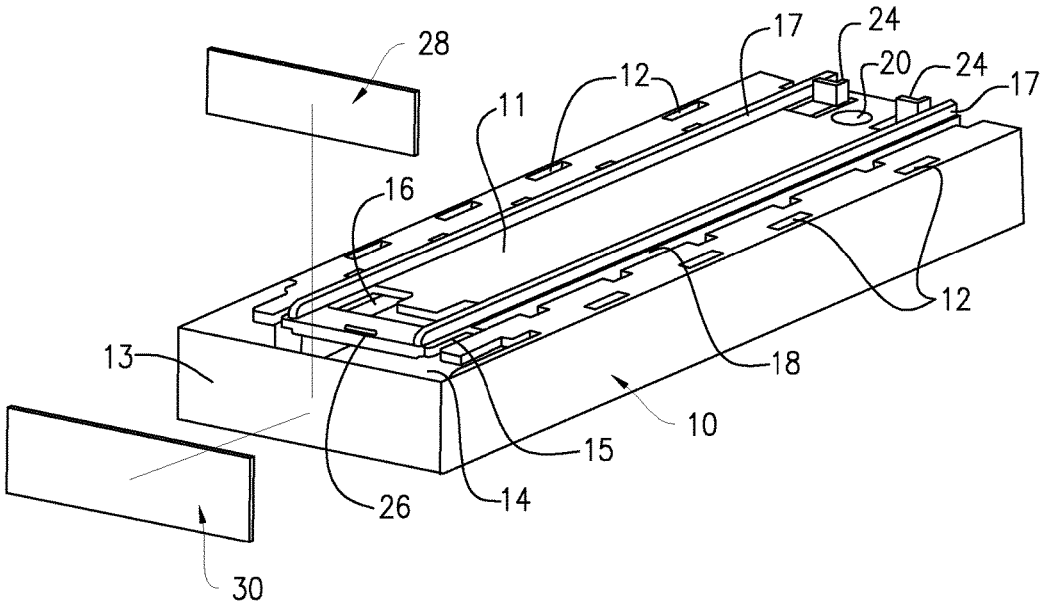
FIG. 2 is a perspective view of a base of an anti-sweep device in accordance with one or more embodiments of the present invention.

Now referring to FIG. 2, the base 10 includes a product bearing side 11, a front end 13, a door aperture 14 sized and configured to accommodate door 50, a product retention tab receiving aperture 16, rails 17 configured to support product or packages, channels 18 for slidably retaining the pusher 170 along the long axis of the base 10, and a pusher biasing element anchoring slot 26. The base 10 may further include apertures 12 disposed along the product bearing side 11 sized and configured to receive housing retention tabs, product support flange apertures 15 sized and configured to permit passage therethrough of one or more product support flanges, a pusher stop receptacle 20, pusher stop resilient tabs 24, a metal plate 28 positioned on an interior surface of the front end 13 and one or more labels 30.

Figure 3:
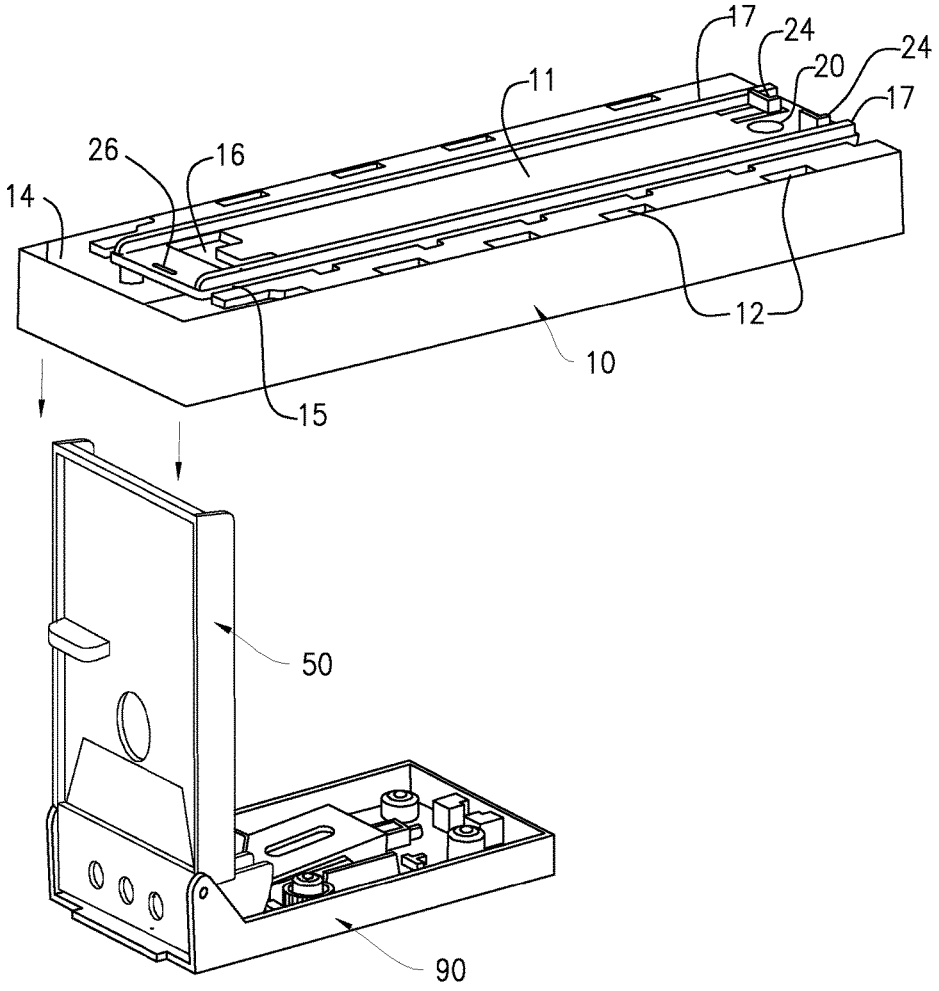
FIG. 3 is a partially exploded perspective view of an anti-sweep device base, door and sled assembly in accordance with one or more embodiments of the present invention.
Figure 4:
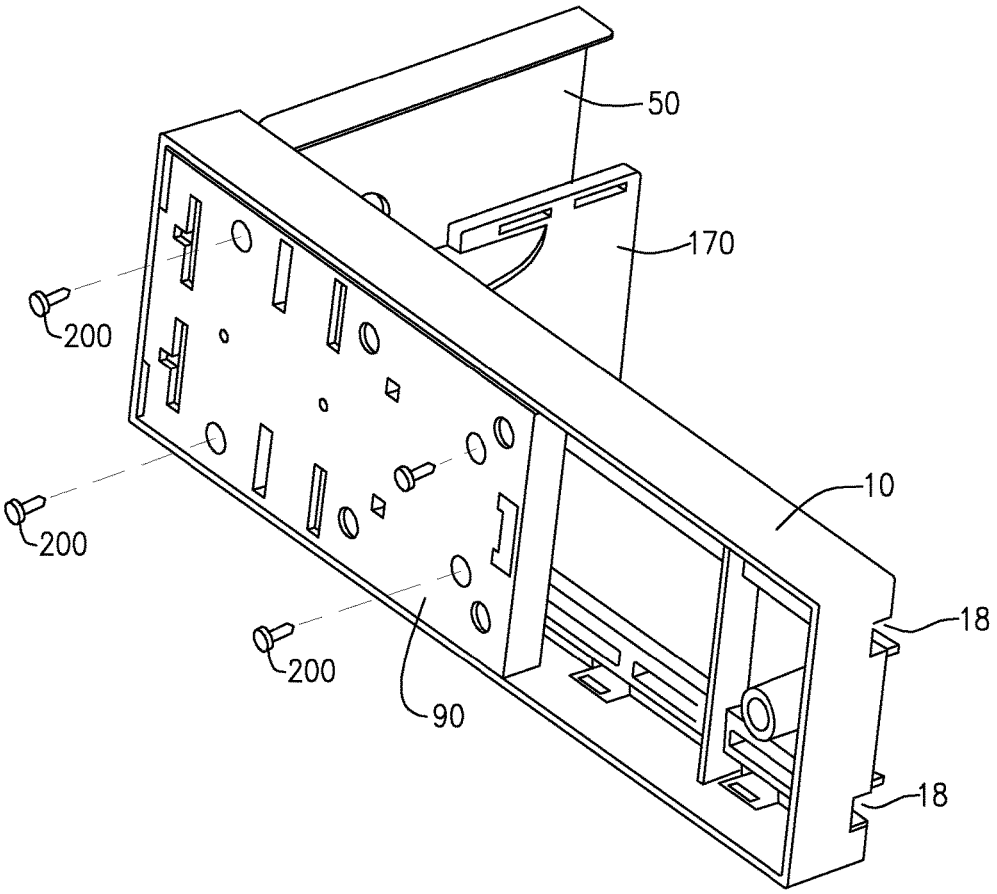
FIG. 4 is a bottom perspective view of anti-sweep device base, a pusher disposed on the product-bearing side of the base and a sled assembly chassis coupled to the bottom of the base in accordance with one or more embodiments of the present invention.

With further reference to FIG. 3, the door 50 may be pivotably mounted to a sled assembly 90. The door aperture 14 of the base 10 accommodates pivotable movement of the door 50. For convenient assembly, door 50 is passed through door aperture 14 and, with further reference to FIG. 4, the sled assembly 90 is coupled to the base 10 using one or more fasteners 200 such as but not limited to screws.

Figure 5:
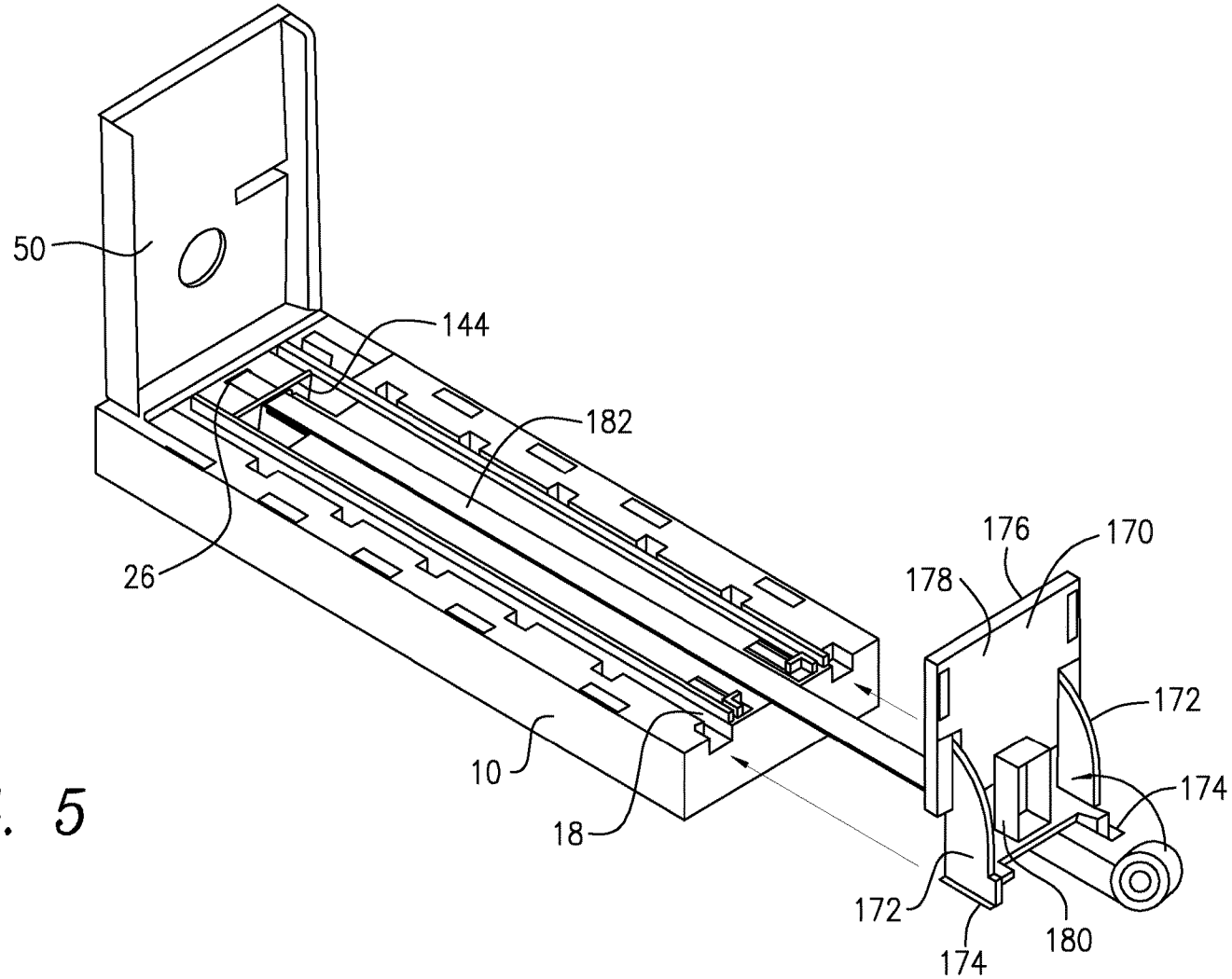
FIG. 5 is a rear perspective view of an anti-sweep device base and door with a pusher in a pre-assembled position relative to the base in accordance with one or more embodiments of the present invention.
Figure 5A:
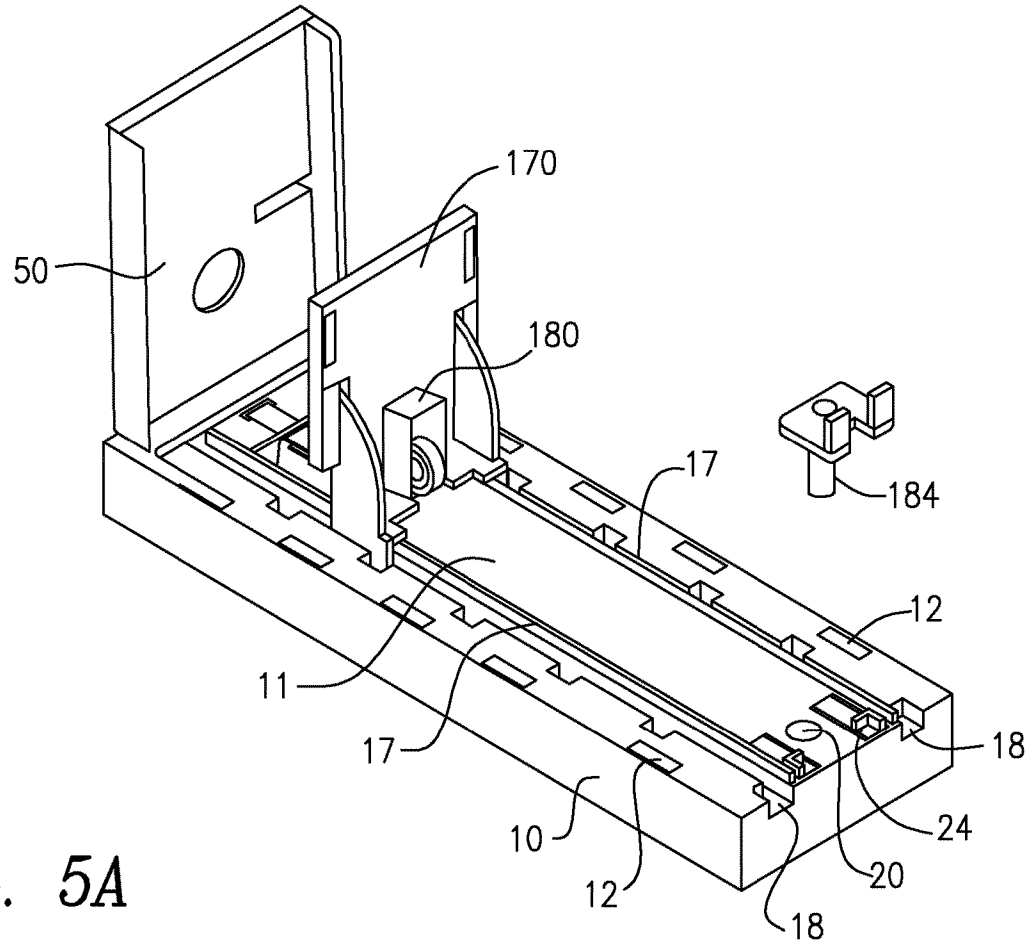
FIG. 5A is a rear perspective view of an anti-sweep device base and door with a pusher in a forward position relative to the base in accordance with one or more embodiments of the present invention.

Now referring to FIGS. 5 and 5A, pusher 170 includes legs 172, feet 174 extending therefrom, a front face 176 and rear face 178. Channels 18 of base 10 are configured to accommodate feet 174 of pusher 170, and rails 17 support pusher 170. A pusher biasing element retention bracket 180 retains a first end of a pusher biasing element 182 such as but not limited to a variable force spring. Pusher biasing element 182 is coupled to the base 10 via pusher biasing element anchoring slot 26. The pusher biasing element 182 biases the pusher 170 in the direction of the door 50. For ease of installation of the pusher 170 on the base, the feet 174 of the pusher 170 may be aligned with and inserted in channels 18 at the end of the base 10 opposite the front end 13, and pusher stop resilient tabs 24 depressed to allow the pusher 170 to slide past the pusher stop resilient tabs 24. Once the pusher 170 has slid past the pusher stop resilient tabs 24, the pusher stop resilient tabs 24 serve as stops to prevent the pusher 170 from being pushed beyond the end of the base 10. A pusher stop 184 may be removably inserted in pusher stop receptacle 20 to provide an additional stop. Removal of the pusher stop 184 and depression of pusher stop resilient tabs 24 permits removal of the pusher 170 from the base 10.

Figure 6:
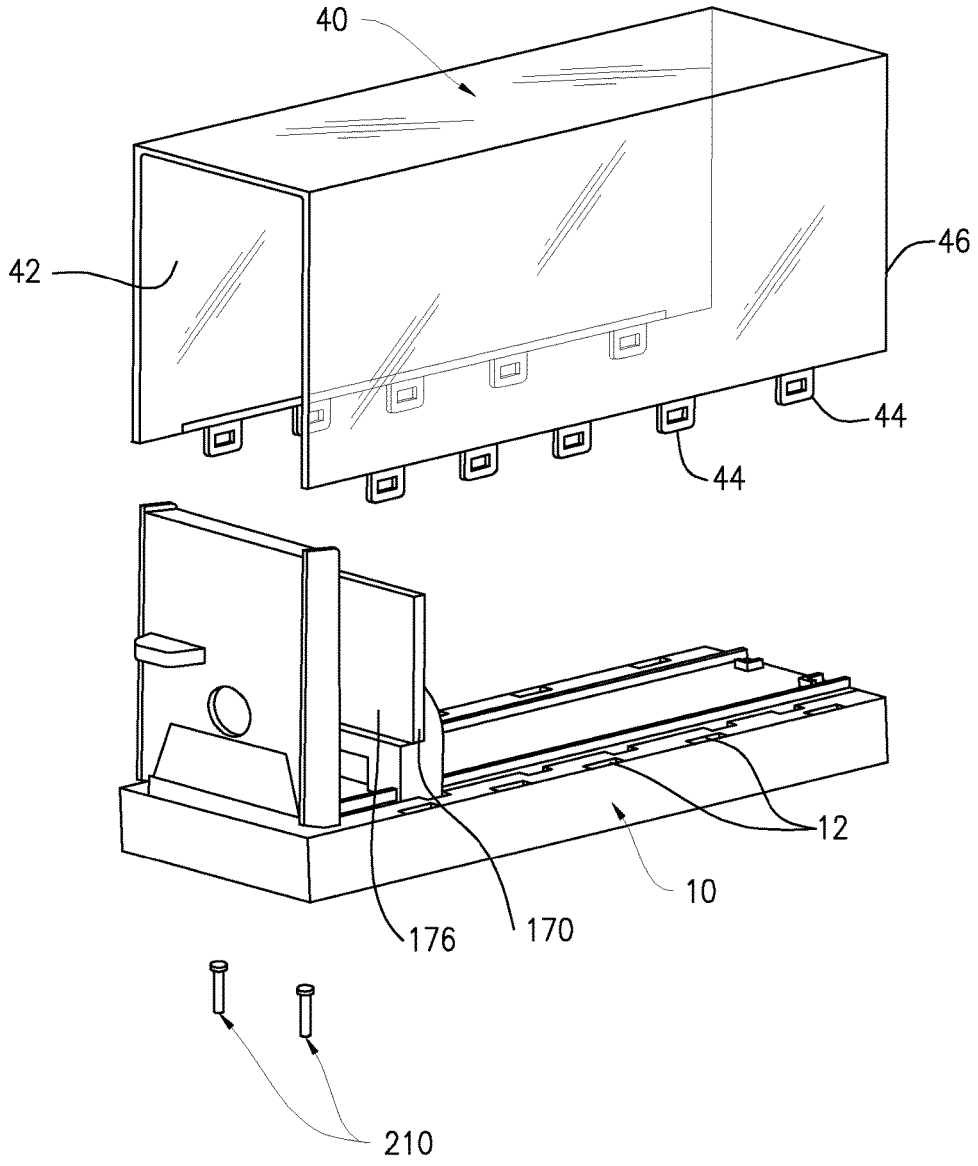
FIG. 6 is a partially exploded perspective view of an anti-sweep device base and door with a pusher and a housing in accordance with one or more embodiments of the present invention.

With reference to FIG. 6, housing 40 having opening 42 and an opposite end 46 includes tabs 44 configured to secure the housing 40 to the base 10 using apertures 12. The anti-sweep device 2 may be fixed to a shelf or other suitable mount using carriage bolts 210 or the like. One skilled in the art will recognize that the housing 40 may be configured to house products or packages of various shapes and sizes consistent with the size of the base 10, product bearing side 11 and the door 50. In some embodiments, the housing 40 may not include tabs 44 but be coupled to the base 10 via adhesive or other means. In still other embodiments a housing 40 is formed by pre-existing store shelf hardware, and the anti-sweep device 2 is simply "plugged in" to the space and anchored in place, the space serving as the housing.

Figure 7:
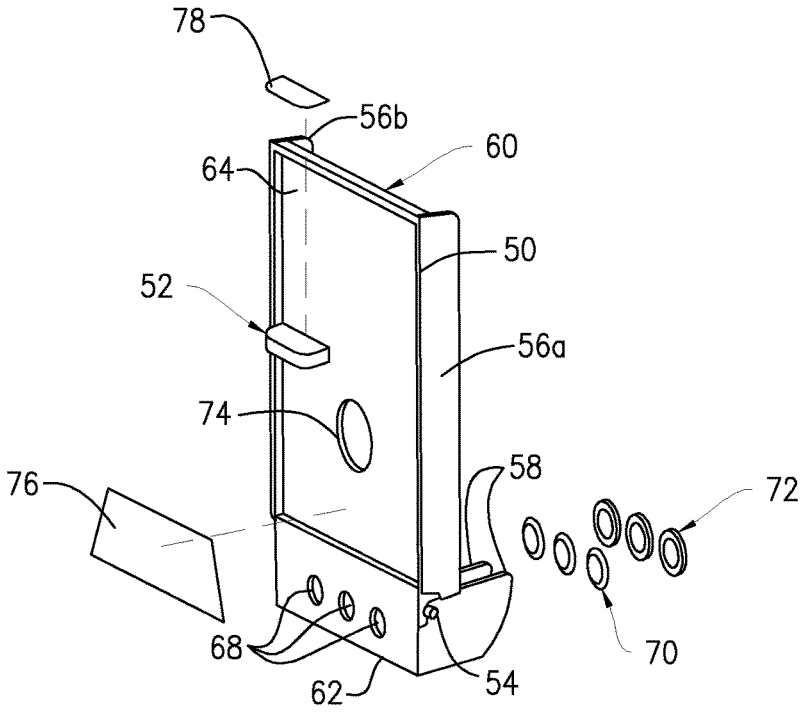
FIG. 7 is an exploded front perspective view of a door of an anti-sweep device in accordance with one or more embodiments of the present invention.
Figure 7A:
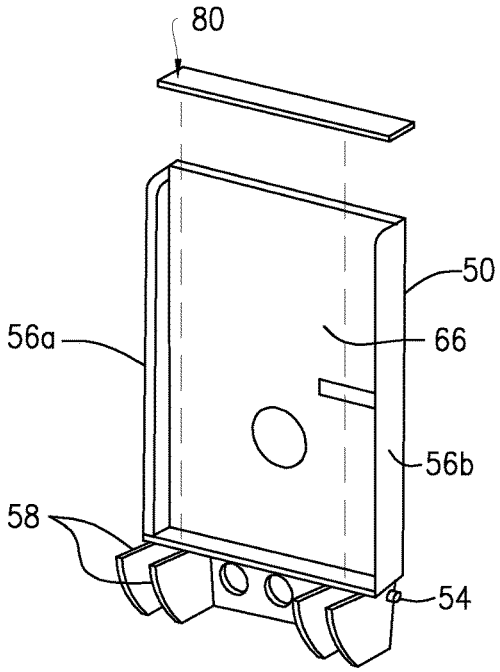
FIG. 7A is a rear perspective view of a door of an anti-sweep device in accordance with one or more embodiments of the present invention.

With reference to FIGS. 7 and 7A, the door 50 includes a front face 64, a top edge 60, a bottom edge 62 and a rear face 66, and opposing walls 56*a* and 56*b* formed at a periphery of the door 50 between the top and bottom edges 60 and 62, respectively, and extending from the door 50 in a direction toward the pusher 170, and further includes at least one product support flange 58 between the opposing walls 56*a* and 56*b* extending in a direction toward the pusher 170. The opposing walls 56*a*, 56*b* and product support flange(s) 58 form a product support structure. The opposing walls 56*a*, 56*b* and products support flange(s) 58 are sized and configured to permit a product or package to nest within the space formed therein, so that when the door 50 is opened, a product or package so nested will tilt outward with the door 50. The door 50 may include a handle 52 extending from the front face 64 and/or a finger opening 74 formed therein. The door 50 may be pivotably coupled to the sled assembly 90 via pivot pin 54. The product support flange apertures 15 permit the passage therethrough of product support flange(s) 58 upon opening the door 50.

The bottom portion of the door 50 may be positioned within the base 10. In some embodiments the bottom portion of the door 50 may include one or more magnet retention apertures 68, magnets 70 and magnet retainer caps 72. The magnets 70 are positioned to magnetically attract the metal plate 28 of base 10. The magnets 70 are operable via interaction with the metal plate 28 to urge the door 50 to close once it is released by a user. The door 50 may further include one or more labels 76 and 80, such as but not limited to instruction and/or product identification labels.

Figure 8A:
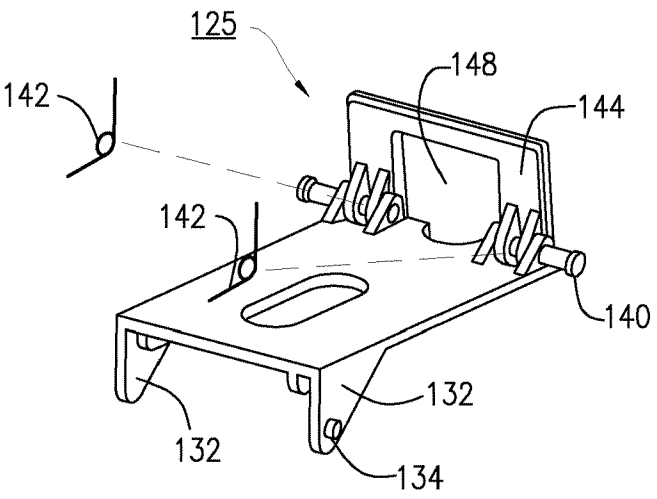
FIG. 8A is a perspective view of a product retention tab and lift plate of an anti-sweep device in accordance with one or more embodiments of the present invention.
Figure 8:
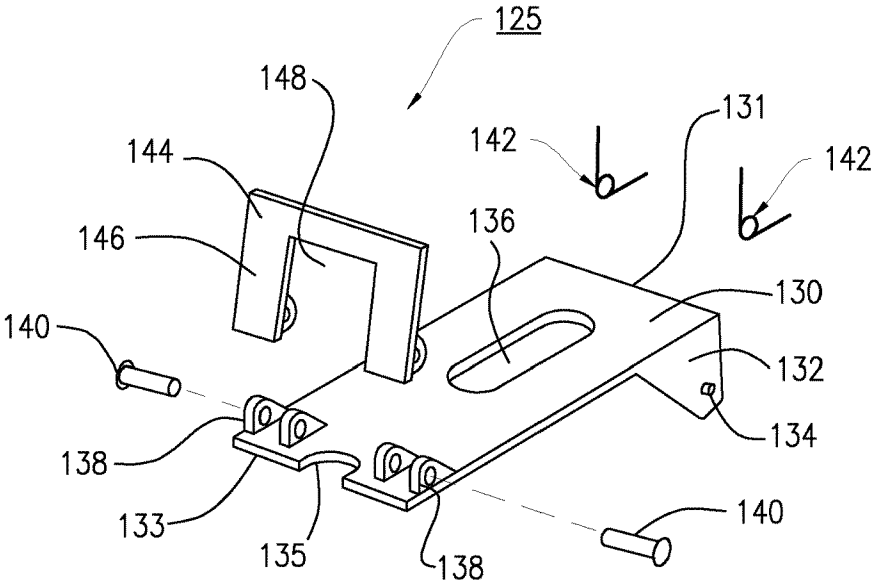
FIG. 8 is an exploded perspective view of a product retention tab and lift plate of an anti-sweep device in accordance with one or more embodiments of the present invention.

Now referring to FIGS. 8 and 8A, a lift plate assembly 125 includes a lift plate 130 and product retention tab 144. Lift plate 130 includes mounting end 131, lift plate legs 132, front end 133, lift plate pivot pins 134, cutout 135, aperture 136, product retention tab joints 138 and hinge pins 140. Product retention tab 144 includes legs 146 and product retention tab aperture 148. Product retention tab 144 is pivotably mounted to lift plate 130 via product retention tab joints 138 and hinge pins 140. Torsion springs 142 may be mounted via hinge pins 140 to permit resilient pivotable movement of the product retention tab 144 relative to the lift plate 130.

Figure 9:
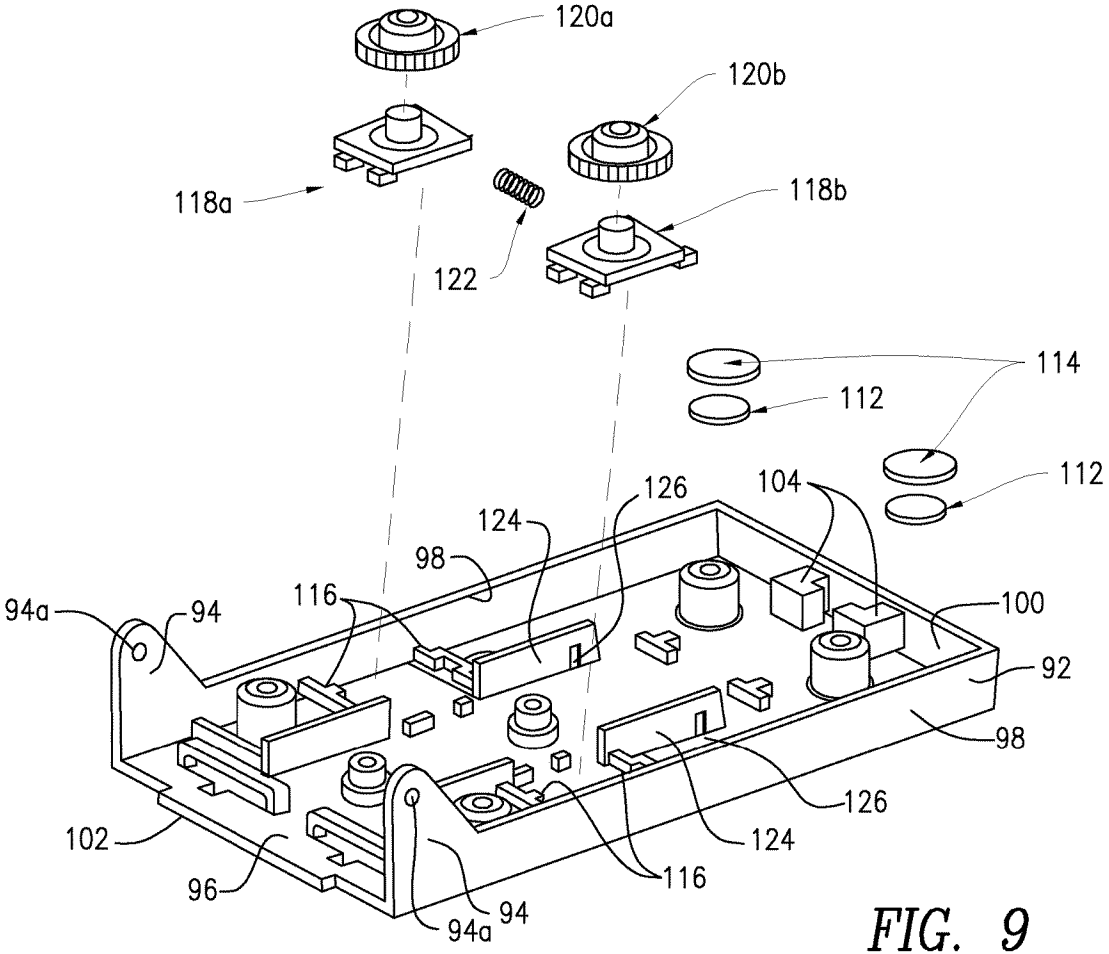
FIG. 9 is an exploded perspective view of a portion of a sled assembly of an anti-sweep device in accordance with one or more embodiments of the present invention.
Figure 10:
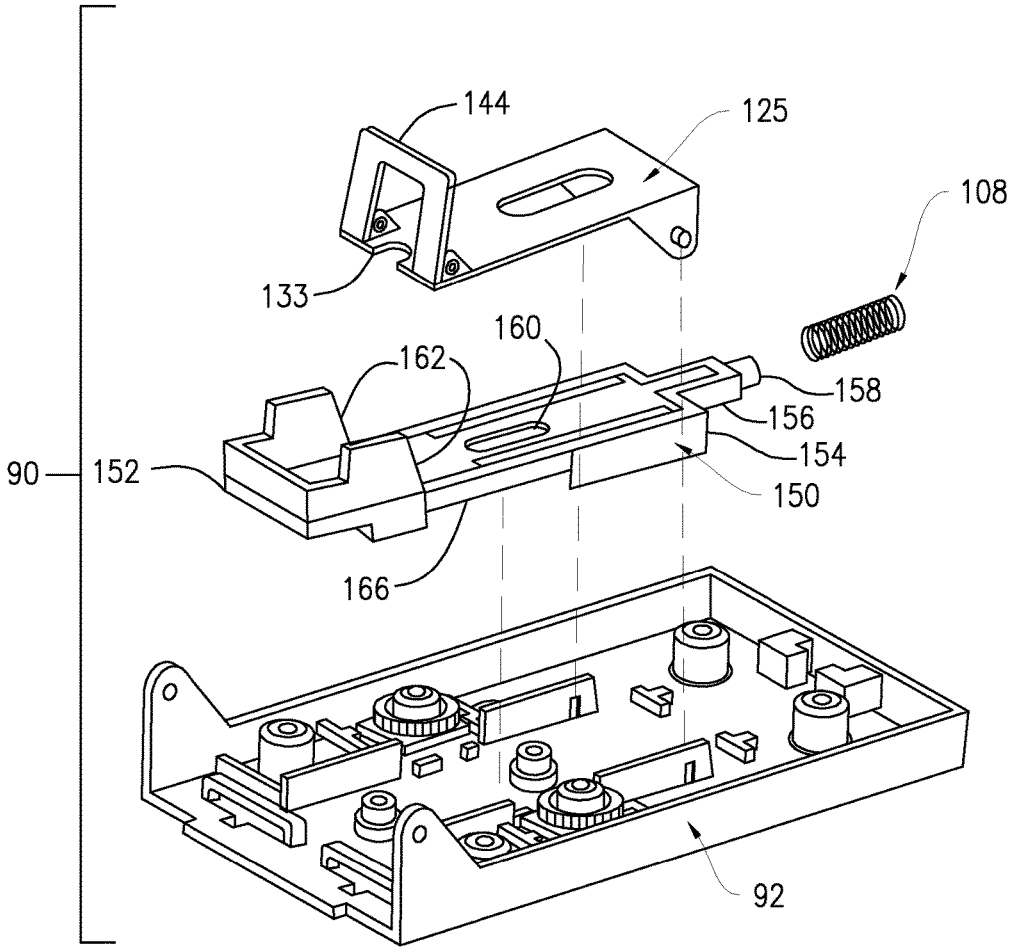
FIG. 10 is an exploded perspective view of a sled assembly of an anti-sweep device in accordance with one or more embodiments of the present invention.
Figure 10A:
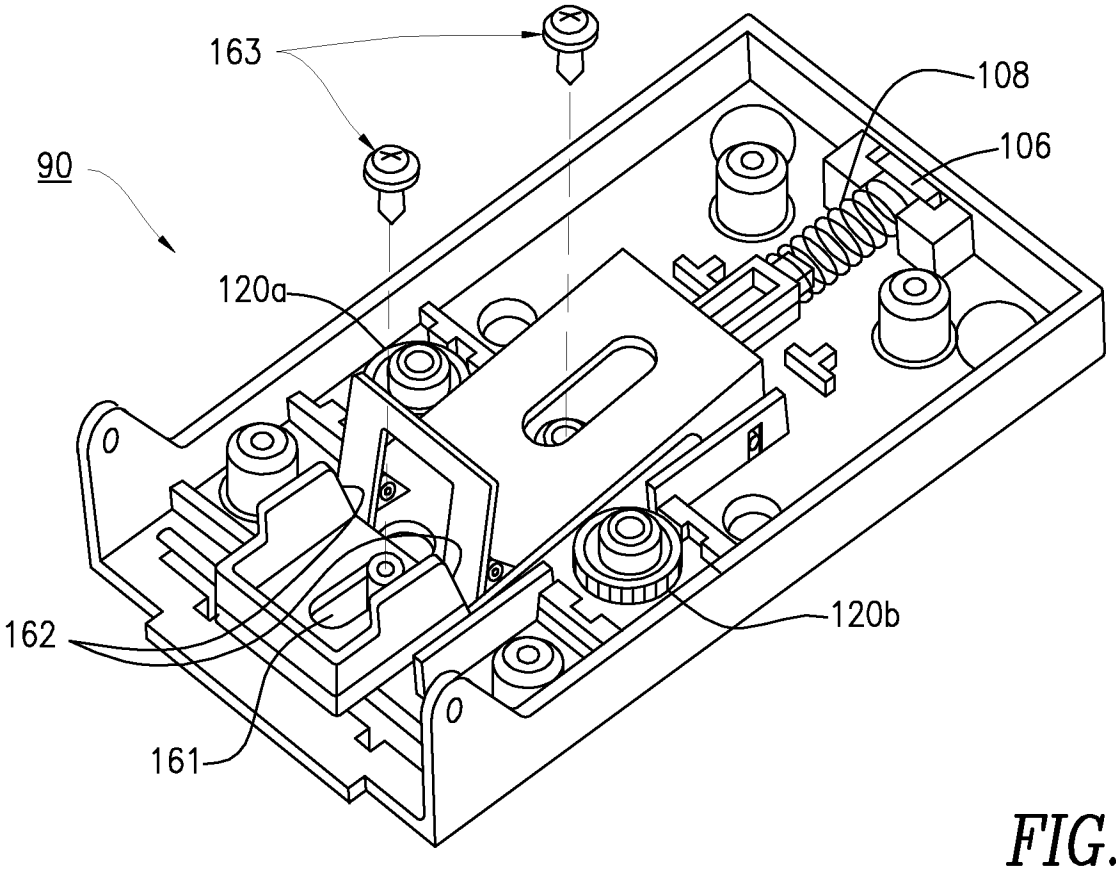
FIG. 10A is a perspective view of the sled assembly of an anti-sweep device according to FIG. 10 in accordance with one or more embodiments of the present invention.

Now referring to FIG. 9-10A, the sled assembly 90 may include a chassis 92. The chassis 92 includes door mounting flanges 94, door mounting apertures 94*a*, floor 96, opposing walls 98, rear wall 100 and front end 102. The chassis 92 further includes an adjustment screw mounting bracket 104, magnets 112, magnet retainer caps 114, gear brackets 116 and lift plate mounting apertures 126. Gear bearings 118*a*, 118*b* are sized and configured to accommodate gears 120*a*, 120*b*, respectively and slidably engage gear brackets 116. One or more of gear bearings 118*a*, 118*b* have damping grease applied to them so the motion of the gears is controlled, slow and consistent. A spring 122 connects gear bearings 118*a*, 118*b* to provide a biasing force urging the gear bearings 118*a*, 118*b* and gears 120*a*, 120*b* toward each other and toward the sled 150 positioned therebetween.

The lift plate assembly 125 is pivotably mounted to the chassis 92 via lift plate mounting apertures 126. The sled 150 is slidably mounted to the chassis 92 and oriented along the longitudinal axis of the base 10. The sled 150 is disposed between the lift plate assembly 125 and the chassis 92. Sled 150 includes a door contacting end 152 and an opposite end 154, a boss 156 extending from the end 154, a sled biasing element mount 158, ramps 162, apertures 160, 161 sized to receive fasteners 163 such as but not limited to screws, and gear engaging surfaces 166. Fasteners 163 are coupled to chassis 92 and permit slidable movement of the sled 150 relative to the chassis 92 along a longitudinal axis of the base 10.

A sled biasing element 108 such as a spring is coupled at one end to the sled biasing element mount 158 and at the opposite end to an adjustment screw 106 positioned in adjustment screw retaining bracket 104. The sled biasing element 108 biases the sled toward end 102 of the chassis 92. The adjustment screw 106 may be or include a thumbwheel to facilitate ease of adjustment. Rotation of the adjustment screw 106 can increase or decrease tension on the sled biasing element 108.

The lift plate assembly 125 is positioned on the sled 150 such that the front end 133 of the lift plate 130 is proximal the ramps 162. Movement of the sled 150 (by opening of the door 50) in the direction of the sled biasing element 108 causes the end 133 of the lift plate 130 to rise up the ramps 162, in turn raising the product retention tab 144. Closing the door 50 releases pressure on the sled 150 and the sled biasing element 108, causing the sled 150 to move in the opposite direction against a damping effect of the gears 120*a*, 120*b* engaged to the gear engaging surface(s) 166, causing the lift plate 130 and product retention tab 144 to be lowered slowly.

Magnets 112 mounted on the chassis 92 may be deployed to secure the device 2 to a store shelf, to prevent removal of the device from the shelf as a whole. It will be apparent to those skilled in the art various means such as but not limited to magnets, bolts, screws, etc. may be employed to secure the device 2 to a shelf.

Figure 11:
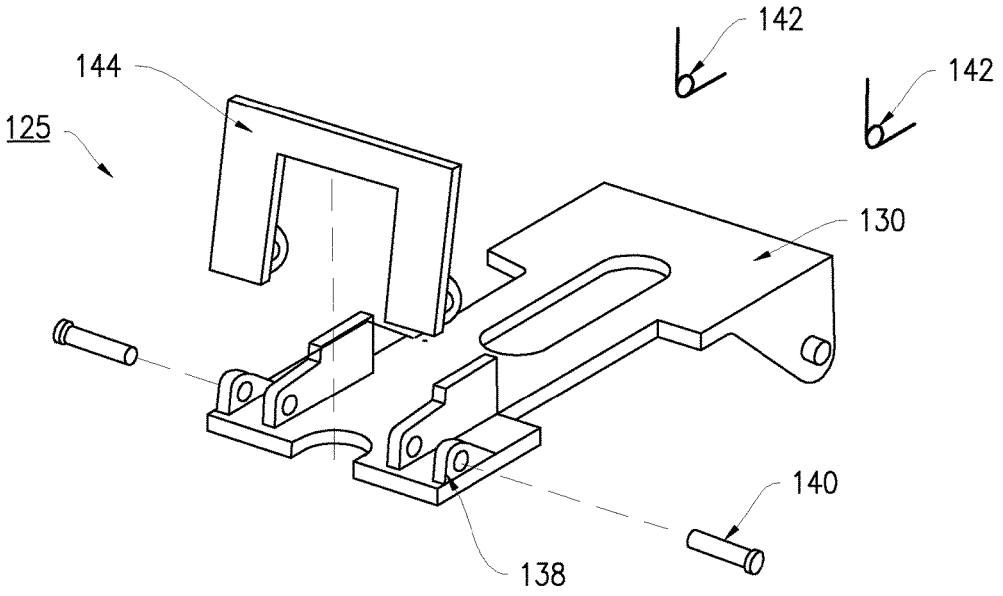
FIG. 11 is a perspective view of a product retention tab and lift plate of an anti-sweep device in accordance with one or more embodiments of the present invention.

With reference to FIG. 11, an alternate embodiment of a lift plate assembly is shown.

Figure 12:
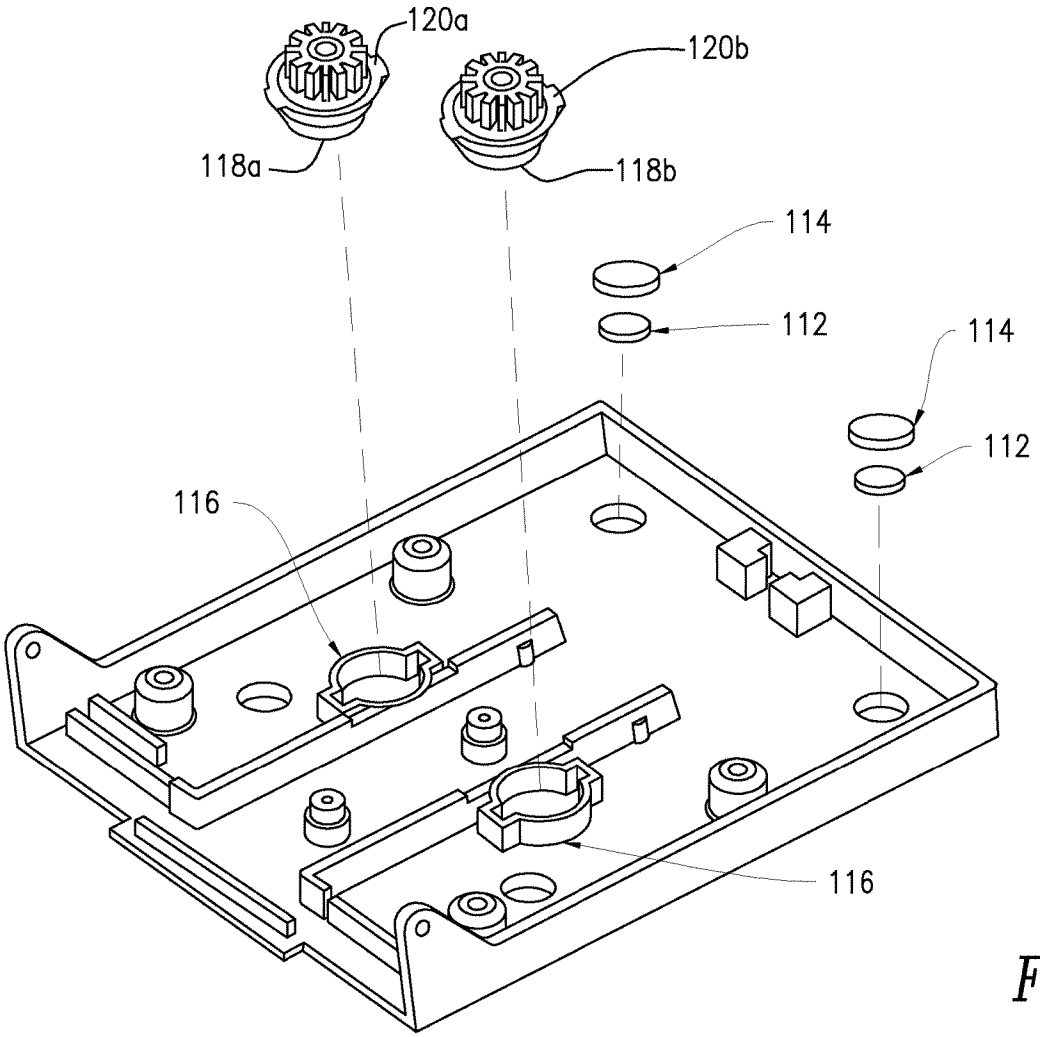
FIG. 12 is an exploded perspective view of a portion of a sled assembly of an anti-sweep device in accordance with one or more embodiments of the present invention.
Figure 13:
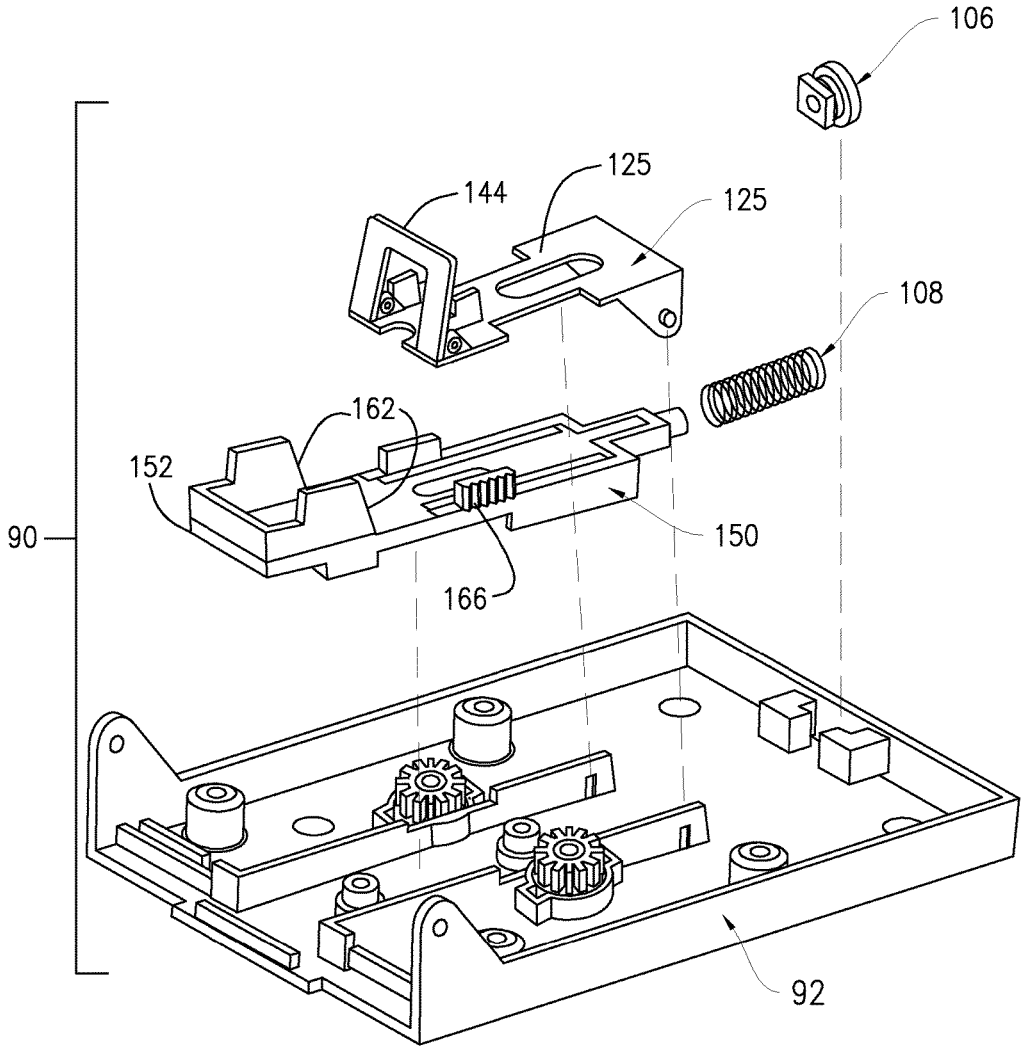
FIG. 13 is an exploded perspective view of a sled assembly of an anti-sweep device in accordance with one or more embodiments of the present invention.
Figure 13A:
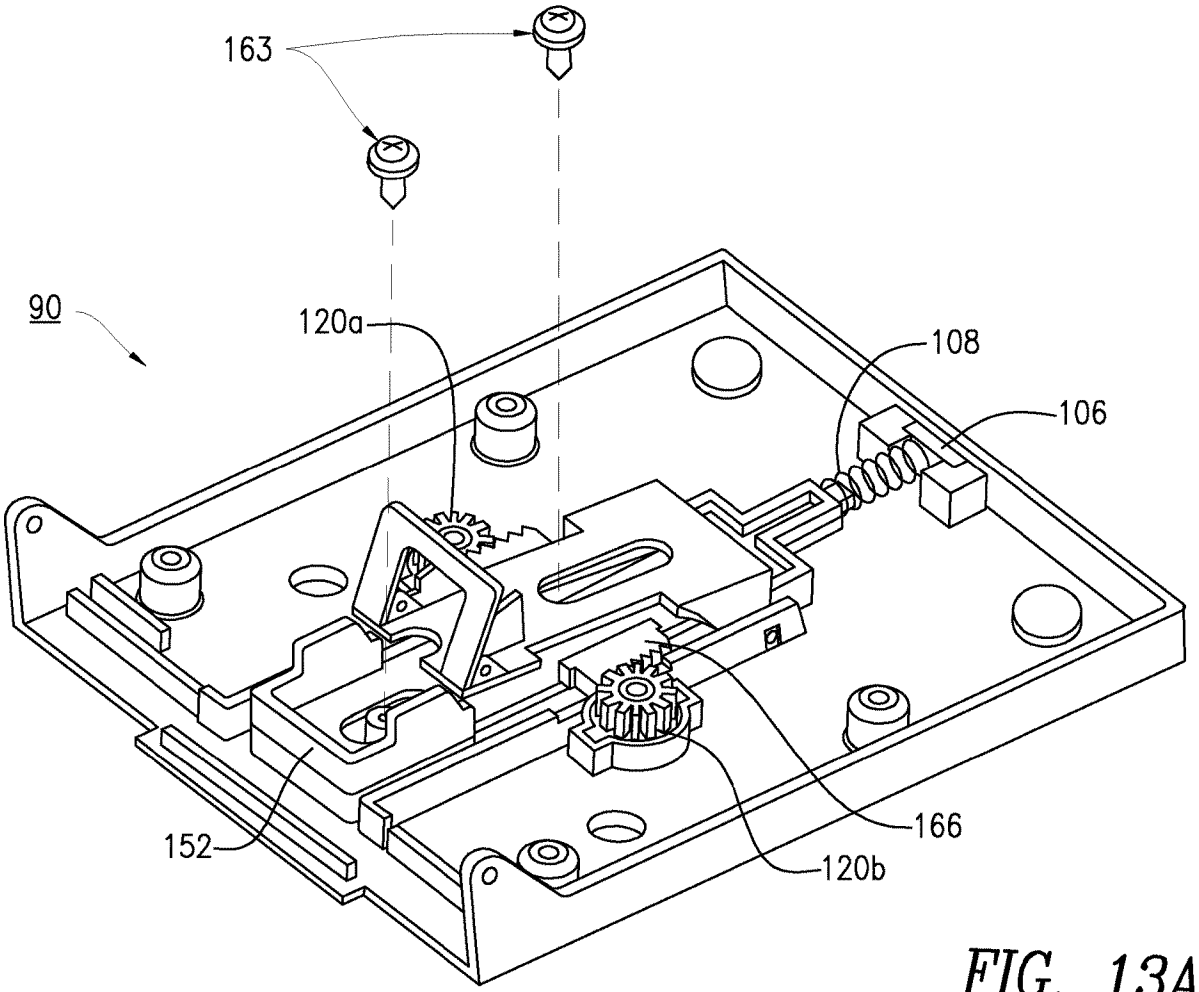
FIG. 13A is a perspective view of the sled assembly of an anti-sweep device according to FIG. 13 in accordance with one or more embodiments of the present invention.

With further reference to FIG. 12-13A, an alternate embodiment of a sled assembly 90 includes 120*a* and 120*b* with bearings 118*a*, 118*b*, respectively. The bearings 118*a*, 118*b* are sealed and contain damping grease to provide slow, controlled resistance against the biasing force of the sled biasing element 108. Gears such as those depicted in this embodiment are commercially available from JSP Components of Victoria, Tex. The bearings 118*a*, 118*b* are coupled to gear brackets 116, and gears 120*a* and 120*b* are coupled to gear engaging surfaces 166.

Figure 14:
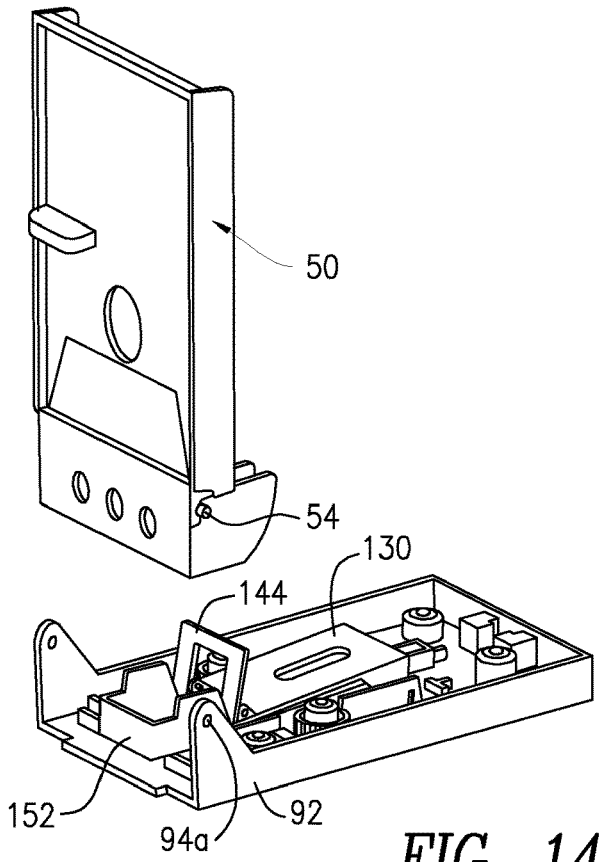
FIG. 14 is an exploded perspective view of the sled assembly of FIG. 10A and a door in accordance with one or more embodiments of the present invention.
Figure 14A:
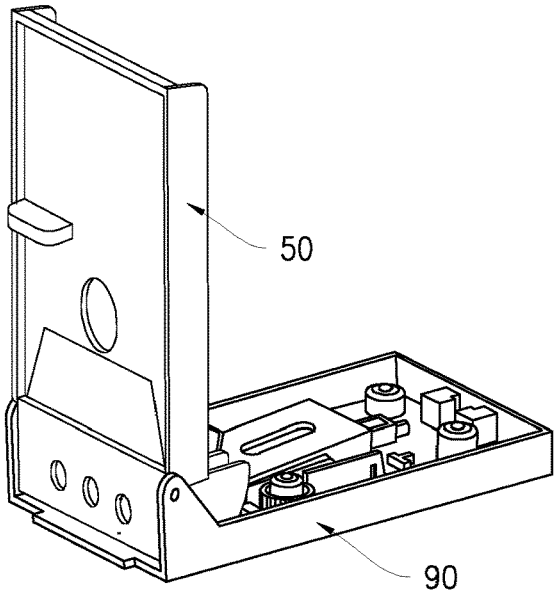
FIG. 14A is a perspective view of the sled assembly and door of FIG. 14 in accordance with one or more embodiments of the present invention.

Now referring to FIGS. 14 and 14A, door 50 is pivotably coupled to chassis 92 via pivot pins 54 coupled to apertures 94*a*.

Although various embodiments of means for retarding a biasing force imparted by the sled biasing element have been illustrated by reference to gears, such means may alternatively take the form of one or more frictional engagement(s) with the sled 150, one or more springs engaged to the sled 150, etc.

Figure 15:
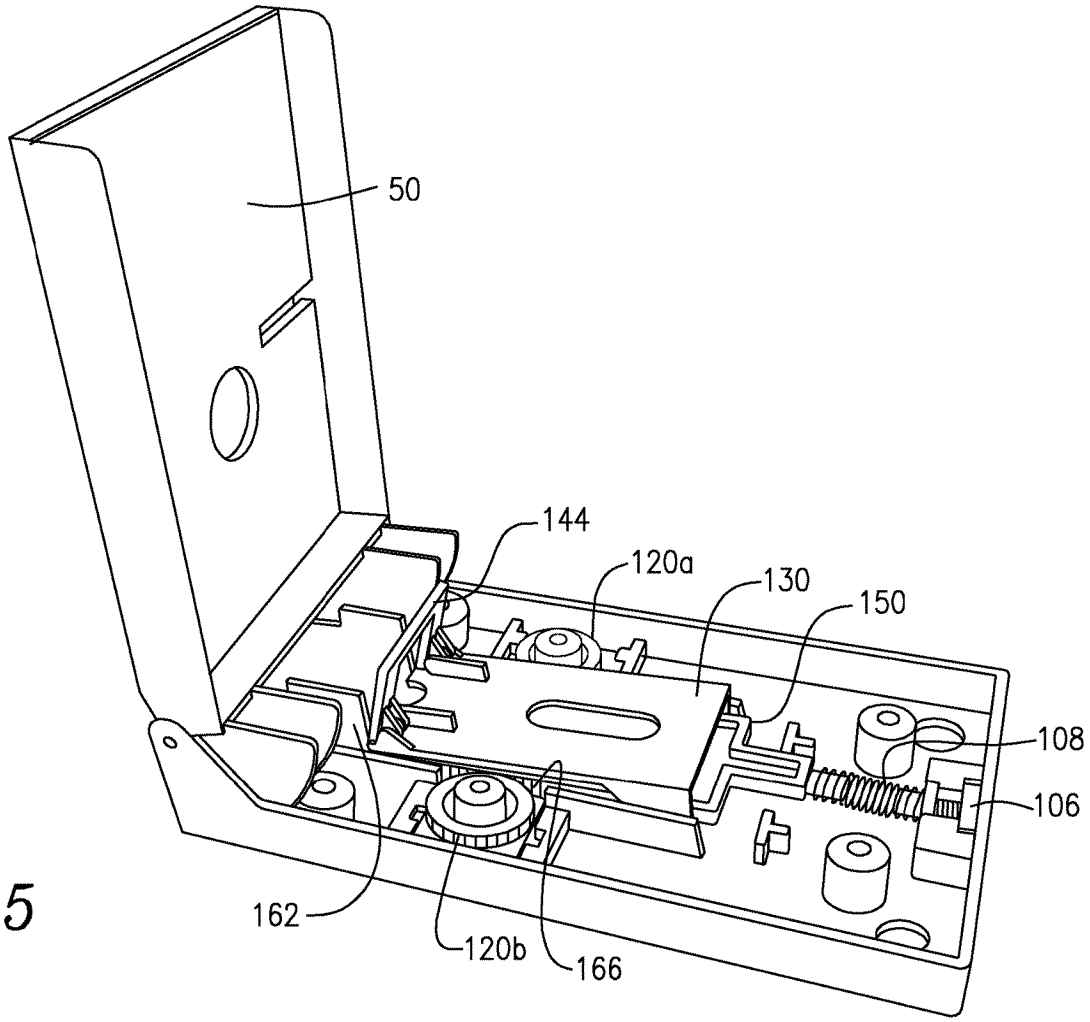
FIG. 15 is an elevated perspective view of a sled assembly and door with the door in a closed position in accordance with one or more embodiments of the present invention.
Figure 15A:
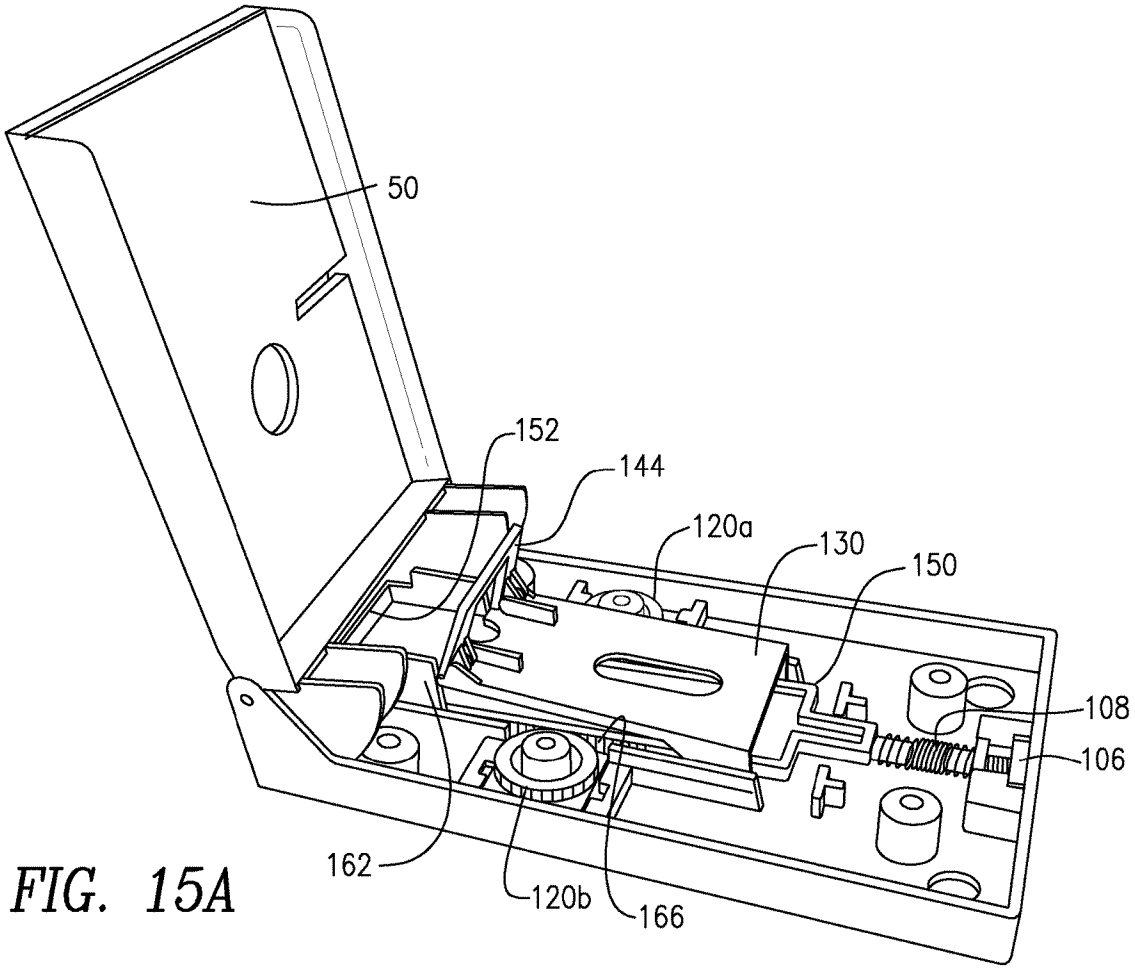
FIG. 15A is an elevated perspective view of a sled assembly and door with the door in a partially opened position in accordance with one or more embodiments of the present invention.
Figure 15B:
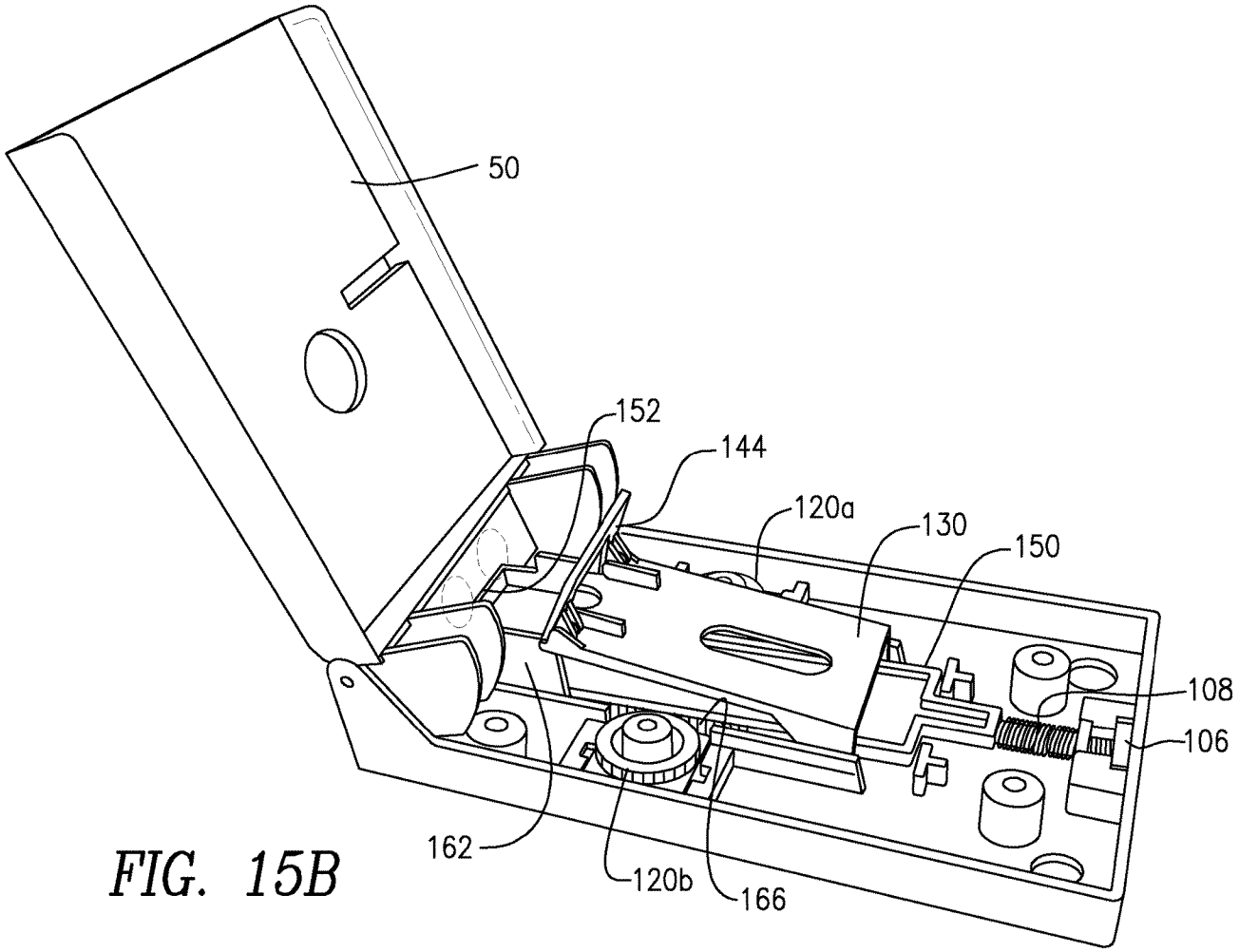
FIG. 15B is an elevated perspective view of a sled assembly and door with the door in a fully opened position in accordance with one or more embodiments of the present invention.

With reference to FIGS. 15-15B, various stages of opening/closing the door 50 depict the resultant movement of the sled 150 and lift plate assembly 125 coupled to the sled 150. FIG. 15 shows the "door closed" position with the lift plate assembly 125 in a lowered position. The sled biasing element 108 in this position is at its least compressed state. Now referring to FIG. 15A, which shows the door partially opened, in use, the action of opening the door 50 to remove a package is operable to pivot the door 50 such that a bottom portion of the door 50 contacts the door contacting end 152, urging the sled 150 against the resistance of the sled biasing element 108, compressing it, and the end 133 of the lift plate 130 to be urged against and ride up the ramps 162, in turn raising the product retention tab 144 rises upward via the lift plate 130 and through the product retention tab aperture 16 formed in the base 10 (not shown) to stop the next package from moving forward. FIG. 15B shows the door 50 in the fully opened position and the product retention tab 144 in the highest raised position. Keeping the door 50 open causes the product retention tab 144 to stay in the raised position, preventing advancement of the next package. Upon closing the door 50, the sled biasing element 108 urges the sled 150 forward, toward the door 50, against the damping effect of the gears 120*a*, 120*b*, lowering the product retention tab 144 slowly. Once the product retention tab 144 has retracted through the product retention tab aperture 16, the next package is advanced to a dispensing position due to the biasing force exerted by pusher biasing element 182, and the door 50 can be opened to access the package. In the event the door 50 is opened before the product retention tab 144 has completely retracted, the opening of the door is operable to raise the product retention tab 144, blocking the next package from advancing to a dispensing position.

Although the devices and systems of the present disclosure have been described with reference to exemplary embodiments thereof, the present disclosure is not limited thereby. Indeed, the exemplary embodiments are implementations of the disclosed systems and methods are provided for illustrative and non-limitative purposes. Changes, modifications, enhancements and/or refinements to the disclosed systems and methods may be made without departing from the spirit or scope of the present disclosure. Accordingly, such changes, modifications, enhancements and/or refinements are encompassed within the scope of the present invention.

What is claimed is:

1. An anti-sweep device for dispensing products one at a time comprising:

a door operable to have an open position and a closed position, the door restricting access to at least one product which may be housed within the dispensing device;

a base comprising a product bearing side and a pusher assembly operable to urge product along the product bearing side in the direction of the door;

a sled assembly coupled to the base comprising a chassis, a sled slidably coupled to a floor of the chassis and axially aligned with the base, the sled comprising a door-contacting end, an opposite end coupled to a sled biasing element and at least one ramp extending from the sled in a direction opposite the floor of the chassis, the sled assembly further comprising a means for retarding a biasing force imparted by the sled biasing element, the sled assembly further comprising a lift plate coupled at a first end to the chassis and positioned between a top surface of the sled and the base, the lift plate further comprising a ramp-contacting end opposite the first end; and a housing configured to contain at least one product to be dispensed, the housing comprising an end sized and configured to accommodate the door;

wherein when the door is opened, a bottom portion of the door is operable to contact and urge the sled against resistance of the sled biasing element, causing the ramp to urge the lift plate ramp-contacting end upward and a product retention tab to rise through a product retention tab aperture to prevent product advancement along the product bearing side, and wherein closing the door releases pressure on the sled, wherein the sled biasing element is operable to urge the sled toward the door against a retarding force imparted by the means for retarding a biasing force, causing the lift plate to be lowered.

2. The invention of claim 1 wherein the means of retarding a biasing force imparted by the sled biasing element comprises at least one gear rotatably mounted to the chassis and positioned to engage at least one gear engaging surface of the sled.

3. The invention of claim 1 wherein the product retaining tab extends from the lift plate proximal the ramp contacting end of the lift plate.

4. The invention of claim 3 wherein the product retaining tab is pivotably coupled to the lift plate.

5. The invention of claim 1 wherein the lift plate is pivotably coupled at the first end to the chassis.

6. The invention of claim 2, wherein the at least one gear comprises damping grease applied to a bearing of the at least one gear.

7. The invention of claim 2 comprising gears positioned in opposition to each other on either side of the sled.

8. The invention of claim 6 wherein the gears are coupled to respective gear bases and the respective gear bases are slidably mounted to the chassis to move reciprocally in a direction transverse to the sled, and wherein the respective gear bases are coupled to each other via a biasing element configured to bias the gear bases toward each other.

9. The invention of claim 1 wherein the pusher assembly comprises a pusher slidably coupled to the product bearing surface of the base and a pusher biasing element coupled at a first end to the pusher and at a second, opposite end to the base proximal the door, wherein the pusher biasing element extends through an opening formed in the product retention tab.

10. The invention of claim 9 wherein the base comprises at least one pusher retention tab positioned on the product bearing side proximal an end of the base opposite the door, the at least one pusher retention tab configured to stop the pusher from extending past the pusher retention tabs.

11. The invention of claim 9 comprising a pusher stop receptacle positioned on the product bearing side proximal an end of the base opposite the door, and a pusher stop configured to removably fit in the pusher receptacle.

12. The invention of claim 1 wherein the door comprises a planar surface comprising a top edge, a bottom edge and opposing walls formed at a periphery of the planar surface between the top and bottom edges and extending from the planar surface in a direction toward the pusher, and further comprising at least one support surface between the opposing walls extending from the planar surface in a direction toward the pusher, the opposing walls and support surface forming a product support structure.

13. The invention of claim 1 wherein the door is pivotably coupled to the chassis.

14. The invention of claim 1 wherein a bottom portion of the door is positioned within the base.

15. The invention of claim 14 wherein the bottom portion of the door comprises at least one magnet.

16. The invention of claim 15 wherein a base region proximate the bottom portion of the door comprises a metal plate.

17. The invention of claim 1 further comprising a sled biasing element adjustment device coupled to the chassis and the sled biasing element.

18. The invention of claim 17 wherein the sled biasing element adjustment device comprises a thumbwheel threadably engaged to a nut.

19. The invention of claim 1 wherein the housing is coupled to the base.

* * * * *